US011828245B2

(12) United States Patent
Drouyer et al.

(10) Patent No.: US 11,828,245 B2
(45) Date of Patent: Nov. 28, 2023

(54) CONTROL FOR A PIEZO-ELECTRIC INJECTOR WHEN A FOOT IS RAISED FROM THE ACCELERATOR

(71) Applicant: VITESCO TECHNOLOGIES GMBH, Regensburg (DE)

(72) Inventors: Morgan Drouyer, Toulouse (FR); Quentin Dussardier, Toulouse (FR)

(73) Assignee: VITESCO TECHNOLOGIES GMBH, Regensburg (DE)

( * ) Notice: Subject to any disclaimer, the term of this patent is extended or adjusted under 35 U.S.C. 154(b) by 0 days.

(21) Appl. No.: 17/910,146

(22) PCT Filed: Mar. 8, 2021

(86) PCT No.: PCT/EP2021/055715
§ 371 (c)(1),
(2) Date: Sep. 8, 2022

(87) PCT Pub. No.: WO2021/180613
PCT Pub. Date: Sep. 16, 2021

(65) Prior Publication Data

US 2023/0098221 A1 Mar. 30, 2023

(30) Foreign Application Priority Data

Mar. 11, 2020 (FR) ..... 2002405

(51) Int. Cl.
*F02D 41/38* (2006.01)
*F02D 41/20* (2006.01)
*F02D 41/12* (2006.01)

(52) U.S. Cl.
CPC ..... *F02D 41/3872* (2013.01); *F02D 41/123* (2013.01); *F02D 41/2096* (2013.01);
(Continued)

(58) Field of Classification Search
CPC ..... F02D 41/123; F02D 41/2096; F02D 41/3872; F02D 2041/2024; F02D 2200/0602
See application file for complete search history.

(56) References Cited

U.S. PATENT DOCUMENTS 6,895,940 B2 * 5/2005 Igashira ..... F02M 63/0225 123/480
7,873,460 B2 * 1/2011 Nakata ..... F02D 41/222 123/457

(Continued)

FOREIGN PATENT DOCUMENTS

| | | |
|---|---|---|
| DE | 199 54 023 | 5/2000 |
| DE | 10 2015 210 051 | 12/2016 |
| WO | 2013/139723 | 9/2013 |

OTHER PUBLICATIONS

Igashira, DE 19954023, machine translation. (Year: 2000).*

(Continued)

*Primary Examiner* — Phutthiwat Wongwian
*Assistant Examiner* — Mark L. Greene
(74) *Attorney, Agent, or Firm* — NIXON & VANDERHYE

(57) ABSTRACT

Disclosed is a method for discharging the pressure in a fuel supply rail of an injection system of an engine, the fuel injection rail connected to a fuel tank by piezo-electric injectors, each including a needle and a piezo-electric actuator pressing on a servo valve of the injector. The injection system includes a fuel pressure sensor and an electrical generator transmitting electric current pulses to each actuator. When the accelerator is released, a first electrical command allows determination of a moment of opening of the respective servo valve without triggering an injection. A second electrical command triggers a discharge of fuel from the fuel supply rail to the tank and therefore to discharge the (Continued)

pressure of the supply rail without triggering an injection. The second electrical command charges the piezo-electric actuator between a first voltage level that opens the servo valve, and a second voltage level triggering an injection.

20 Claims, 6 Drawing Sheets

(52) U.S. Cl.
CPC ..... *F02D 2041/2024* (2013.01); *F02D 2200/0602* (2013.01)

(56) References Cited

U.S. PATENT DOCUMENTS

| | | | |
|---|---|---|---|
| 9,945,338 | B2 | 4/2018 | Zhang et al. |
| 2015/0027415 | A1 | 1/2015 | Radeczky |

OTHER PUBLICATIONS

International Search Report for PCT/EP2021/055715, dated May 26, 2021, 4 pages.
Written Opinion of the ISA for PCT/EP2021/055715, dated May 26, 2021, 6 pages.

* cited by examiner

CONTROL FOR A PIEZO-ELECTRIC INJECTOR WHEN A FOOT IS RAISED FROM THE ACCELERATOR

This application is the U.S. national phase of International Application No. PCT/EP2021/055715 filed Mar. 8, 2021, which designated the U.S. and claims priority to FR Patent Application No. 2002405 filed Mar. 11, 2020, the entire contents of each of which are hereby incorporated by reference.

TECHNICAL FIELD

The present invention concerns a method for controlling a piezo-electric actuator on release of an accelerator, and in particular the regulation of the fuel pressure in the supply rail of an injection system.

PRIOR ART

Traditionally, an injection engine comprises injectors able to inject fuel into respective cylinders, and a fuel supply rail for the injectors, the fuel being subjected to a defined pressure in the rail via a high-pressure pump.

It is however necessary to discharge the pressure in the fuel supply rail during driving of the vehicle and in particular when the driver raises his foot from the accelerator. In fact, the pressure in the supply rail is dependent on the engine speed and torque requested by the user. Thus, when the accelerator is released, the engine torque and speed are modified, and not reducing the fuel pressure in the rail would lead to a lower quality of combustion when the driver re-accelerates, affecting both the vehicle and the driver.

At present, injection engines comprise a pressure decay valve in the supply rail, which allows correct discharge of the pressure in the supply rail when necessary. However, the addition of this type of valve entails additional costs and increases the complexity of existing injection systems, taking into account the tightness which must be ensured throughout its service life and the addition of extra control cables. Similarly, to control the valve, an additional electronic stage must be implemented in the control unit and a valve control strategy must be introduced. It is therefore advantageous to find a solution allowing discharge of the fuel pressure in the supply rail without the need to add any components, and in particular without the need to add a discharge valve.

Several strategies have therefore been considered for discharging the fuel pressure in the rail without adding further components to the existing injection system.

In fact it is known, for a piezo-electric injector with servo valve control, to use a fuel leak at the injectors, causing fuel to transfer directly from the supply rail to the vehicle tank without however triggering an undesired injection when the accelerator is released. In this way, the pressure in the rail is reduced and the injection system remains the same.

In concrete terms, this is translated mechanically by an opening of the injector servo valve sufficiently finely to create a leakage flow between the fuel supply rail and the vehicle tank without triggering an injection. The term "triggering an injection" here means lifting the needle from the injector nozzle and therefore pouring fuel into a combustion cylinder.

The opening of the servo valve is reflected in a pressure exerted on said servo valve by a piezo-electric actuator. In this respect, the opening of the servo valve is controlled by the electrical signal applied to the piezo-electric actuator.

Thus, to trigger an injection, the piezo-electric actuator is subjected to a current of defined intensity for a defined time such that it presses on the servo valve so as to trigger the opening of the needle. It is understood that when no injection is to be triggered, it is necessary to control the electrical signal to the piezo-electric actuator suitably so as to provoke the leakage of fuel to the tank without opening the needle of the injector.

A known control strategy for an electrical signal to produce a leakage of fuel at the injectors proposes the use of several electrical pulses per engine cycle. Each positive electrical pulse has a charge time which is sufficiently long to open the servo valve but sufficiently short for the needle not to open because of its inertia. There is therefore a fuel leak from the fuel supply rail to the tank through the injectors without triggering the injection. More precisely, in reality, a train of two pulses is used to trigger a single leak. The first pulse is a positive current pulse comprising a charge time which is sufficiently long to allow opening of the servo valve and hence leakage of the fuel. This first pulse is almost immediately followed by a second pulse of substantially the same absolute value but negative, allowing closure of the servo valve and hence interruption of the fuel leak. The advantage arises from the fact that the two pulses occur within a time lapse which is so short that the inertia of the needle does not allow this to move, and hence there is no undesired injection.

However, insofar as the two electrical pulses are very close in time in order to avoid an injection, the fuel leakage for each pair of pulses is small. Therefore a plurality of pulses is used per engine cycle so as to cause the pressure in the rail to fall significantly. In fact, using several electrical pulses on each engine cycle imposes a very high stress on the piezo-electric actuator and causes premature wear of the injector.

A second strategy is described by document WO2013139723. The strategy proposes the use of a single pair of electrical pulses per engine cycle. In contrast to the first strategy, the two pulses (positive and negative) of the pair are separated in time by a relatively long duration, thus allowing a large fuel leak if the charge time of the positive pulse is sufficiently long for the servo valve to open, without however being too long. In fact, an overlong duration would trigger an excessive leak, causing an imbalance of pressure applied to the needle (in the sense of a higher force exerted on the base of the needle) such that it would cause the needle to lift, i.e. allow the injection of fuel into the cylinder. It is in reality necessary to charge the piezo-electric actuator to a defined voltage threshold between a first threshold, corresponding to the opening of the servo valve, and a second threshold, greater than the first threshold, corresponding to the opening of the needle.

In this strategy, the charge time of the electrical pulse pairs is deliberately short at the start of each accelerator release phase and is incremented on each engine cycle until a pressure fall in the rail is observed which indicates the opening of the servo valve. When the target pressure fall in the rail is observed, the charge time of the pulse pairs is no longer incremented. In this strategy, the needle never opens if the rate of incrementation of the charge time does not exceed the difference in charge between the value for opening the servo valve and the value for opening the needle.

However, it is understood that it is necessary to wait for a certain number of engine cycles for the fuel leak to take place, which means that under usage conditions of vehicles, this strategy is not sufficiently reactive to cause a sufficiently rapid fall in the pressure of the fuel supply rail.

The present application therefore seeks to remedy the problems posed by the strategies of the prior art.

SUMMARY OF THE INVENTION

One object of the present application is to propose an injection system and an associated method allowing a significant reduction in pressure in the fuel supply rail on each engine cycle, rapidly and reactively, without any addition of further components such as the discharge valve (PDV).

Also, the method causes no premature wear of the injector and does not overstress the piezo-electric actuator.

It is also suitable for use independently of current operating parameters of the engine, such as temperature, or parameters specific to each piezo-electric injector.

To this end, the present application proposes a method for discharging the pressure in a fuel supply rail of an injection system of an engine of a vehicle, said fuel injection rail being connected to a fuel tank by means of a plurality of piezo-electric injectors, each piezo-electric injector comprising a needle and a piezo-electric actuator able to press on a servo valve of the injector, the injection system further comprising a fuel pressure sensor for the supply rail and an electrical generator able to transmit electric current pulses to the piezo-electric actuator of each injector.

The method is implemented during a phase of release of the accelerator for which no fuel injection request has been made, and is characterized in that it comprises the following steps:

comparison by a computer, on each engine cycle, of a defined reference fuel pressure for the fuel supply rail with a measured fuel pressure in the fuel supply rail measured by the pressure sensor, and when the measured pressure is greater than the reference pressure:

sending, by the electrical generator, of a first electrical command to the piezo-electric actuator of at least one injector of the plurality, the first electrical command comprising an electric charge pulse of defined duration and an electric discharge pulse of the piezo-electric actuator, the duration being determined so as to provoke a complete charge of the piezo-electric actuator of the at least one injector, the first electrical command also comprising a defined duration corresponding to the time elapsing between the start of the electric charge pulse and the start of the electric discharge pulse of the piezo-electric actuator of the at least one injector, the duration being determined such that the needle of the at least one injector remains immobile, determination, from a value of a force exerted by the piezo-electric actuator on the servo valve during the first electrical current command, of a charge time duration allowing opening of the servo valve of the at least one injector, sending, by the electrical generator, of a second electrical command to the piezo-electric actuator of said at least one injector, the second electrical command comprising an electric charge pulse of a defined duration and an electric discharge pulse of the piezo-electric actuator, and also comprising a defined duration corresponding to the time elapsing between the start of the electric charge pulse and the start of the electric discharge pulse of the piezo-electric actuator, the charge duration of the second electrical command being determined from the charge time duration of the at least one injector so as to allow an opening of the servo valve of said at least one injector while keeping its needle immobile, so that the voltage at the terminals of the piezo-electric actuator is higher than a first voltage threshold triggering the opening of the servo valve and lower than a second voltage threshold triggering the opening of the needle, the duration being determined as a function of the engine speed, the pressure in the fuel supply rail and the desired pressure discharge.

According to one embodiment, the second electrical current command also comprises a defined duration corresponding to the time elapsing between the start of the electric charge pulse and the start of the electric discharge pulse of the piezo-electric actuator of the at least one injector, the defined duration being greater than a duration allowing breakage of the inertia of the needle of the at least one injector.

According to one embodiment, the opening duration of the servo valve is determined by measuring a voltage applied to the piezo-electric actuator and a quantity value of electric charges transferred from the electrical generator to the piezo-electric actuator of the at least one injector.

According to one embodiment, an opening of the servo valve is detected when the force exerted by the piezo-electric actuator on the servo valve is at a maximum, the force exerted by the piezo-electric actuator on the servo valve being determined from the voltage applied to the piezo-electric actuator, from a capacitance value of the piezo-electric actuator and from a quantity value of electric charges.

According to one embodiment, the charge duration of the second electrical command is equal to the opening duration of the servo valve obtained from the first electrical command, to which a defined duration is added.

According to one embodiment, at least one time lapse not equal to zero separates the two electric commands.

The invention also concerns a computer, characterized in that it is able to control an injection system of an engine of a vehicle, said system comprising a fuel supply rail connected to a fuel tank by means of a plurality of piezo-electric injectors, each piezo-electric injector comprising a needle and a piezo-electric actuator able to press on a servo valve of the injector, the injection system further comprising a fuel pressure sensor for the supply rail and an electrical generator able to transmit electric current pulses to the piezo-electric actuator of each injector, and in that the computer is also able to command the implementation of the steps of a method according to the invention.

The invention also concerns a computer program, comprising code instructions for implementing the steps of a method according to the invention when said program is executed on a computer according to the invention.

The method therefore allows an optimal, rapid and reactive discharge of pressure in the supply rail.

In fact, the fuel leakage between the fuel supply rail and the tank may be maximized for each engine cycle, since the analysis of the force exerted on the servo valve by the piezo-electric actuator allows the servo valve to be opened in a suitable fashion without triggering the injection, independently of the pressure in the rail, throughout the pressure discharge. The pressure discharge may therefore be modified suitably for each engine cycle as a function of the current pressure in the rail.

For the same reason, the method may be applied independently of the current operating conditions of the engine or the parameters specific to each piezo-electric injector, since the development of these parameters is considered on each new implementation of the method.

Finally, the method may be used directly in existing injection systems without the addition of extra components, and in particular without requiring the addition of a discharge valve which would directly increase the cost and complexity of the system.

BRIEF DESCRIPTION OF THE DRAWINGS

Other features, details and advantages will become apparent from reading the following detailed description and from examining the appended drawings, in which.

DESCRIPTION OF THE EMBODIMENTS

Figure 1:
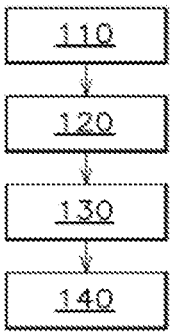
FIG. 1 shows an embodiment of a method of discharging pressure in a fuel supply rail in an injection system of an engine of a vehicle.
Figure 2:
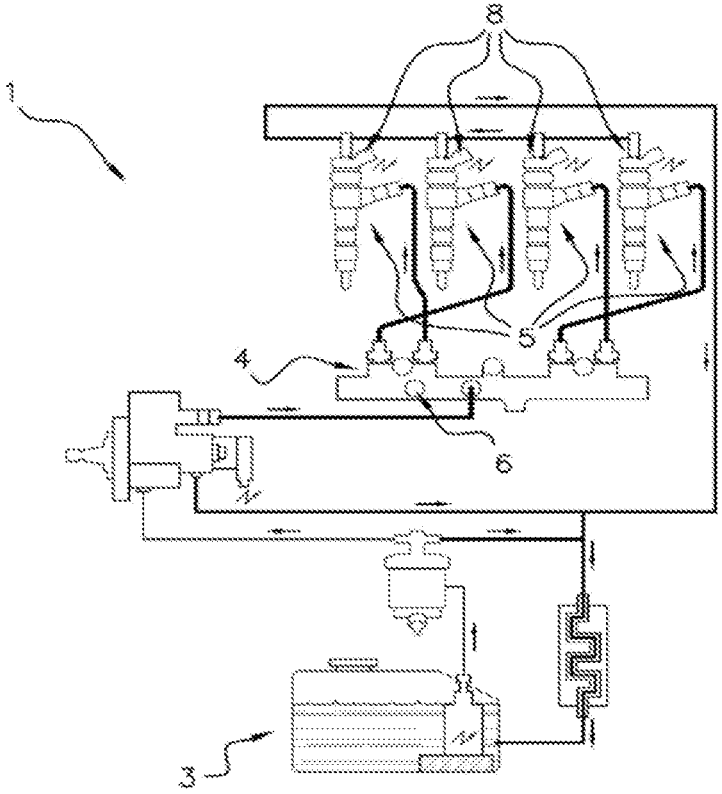
FIG. 2 shows an embodiment of an injection system of an engine of a vehicle in which the method is implemented.
Figure 3A:
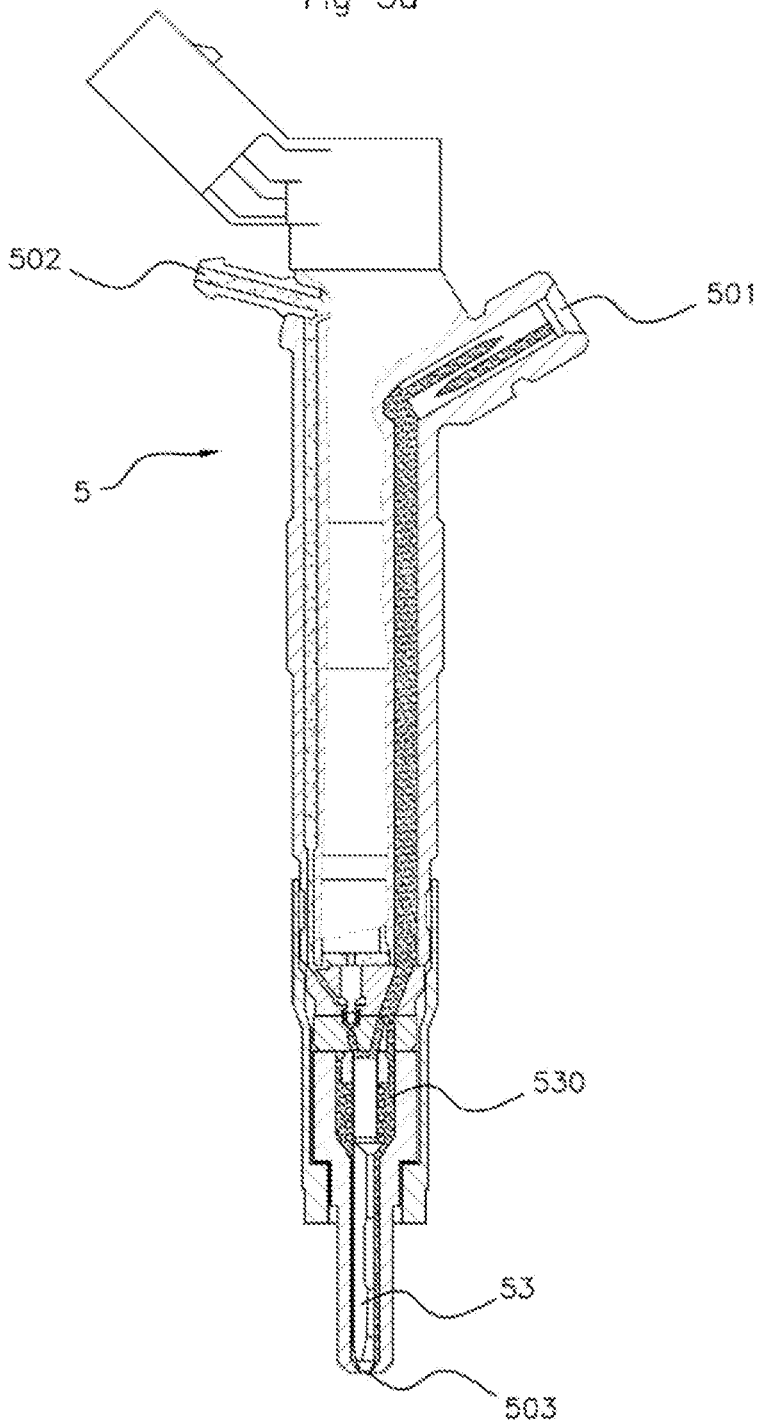
FIG. 3*a* shows a piezo-electric injector in the closed position.
Figure 3B:
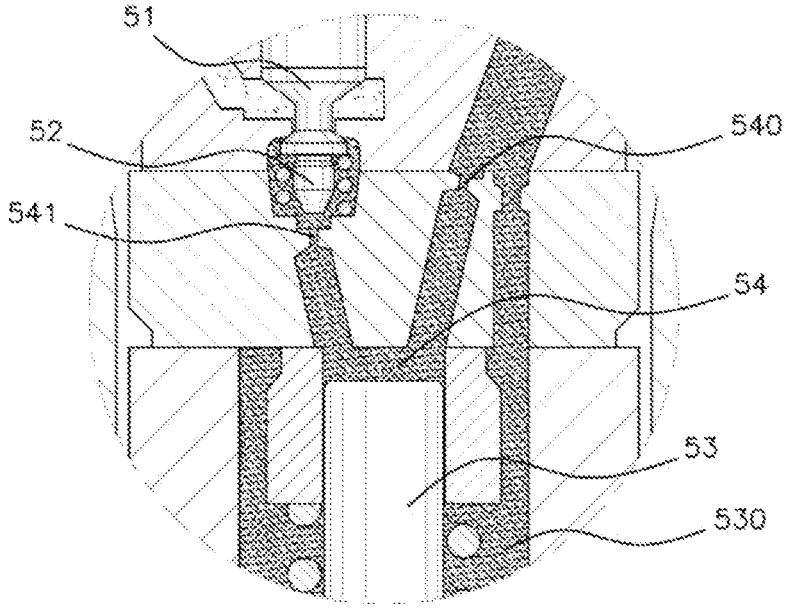
FIG. 3*b* shows an enlarged view of a servo valve and control chamber of the piezo-electric injector from FIG. 3*a*.

Reference is now made to FIG. 2 showing an embodiment of an injection system of an engine of a vehicle. The injection system 1 allows implementation of a method of discharging pressure in a fuel supply rail in an injection system of an engine of a vehicle shown in FIG. 1.

The injection system 1 comprises a fuel supply rail 4 connected to a fuel tank 3 via return lines from a plurality of piezo-electric injectors 5. The fuel present in the supply rail 4 is subjected to a defined pressure in order to promote the good combustion of the fuel during the various injection phases. Therefore it follows a reference pressure $P_{ref}$ determined by an engine computer (not shown). The engine computer may, for example, be a processor, a microprocessor or a microcontroller. It also has a memory which comprises code instructions for controlling the implementation of the steps of the method for discharging pressure shown in FIG. 1. The injection system 1 also comprises a pressure sensor 6 for the fuel of the supply rail 4 and an electrical generator 8. The pressure sensor 6 is used to measure whether the pressure $P_{rail}$ in the rail actually follows the reference pressure $P_{ref}$ determined by the engine computer.

A piezo-electric injector 5 of the injection system 1 is shown in more detail in FIGS. 3*a*, 3*b*, and 4*a*, 4*b*. It comprises a high-pressure fuel inlet 501, a low-pressure fuel outlet 502 to the return line from the injector 5 and hence to the tank, and an orifice 503 for injection of fuel into a combustion chamber of the engine. The injector also comprises a movable needle 53 in a first chamber 530, said first chamber being in fluidic communication with the high-pressure fuel inlet 501, said needle being movable between a first position (shown in FIGS. 3*a* and 3*b*) in which it closes the fuel injection orifice 503, and a second position in which it opens this orifice (position shown in FIGS. 4*a* and 4*b*), thus allowing the injection of fuel into a combustion chamber (not shown).

The injector also comprises a control chamber 54 (see FIGS. 3*b* and 4*b*) arranged at the end of the needle opposite the fuel injection orifice. The control chamber 54 is in fluidic communication with the high-pressure fuel inlet 501 via a restriction 540, and in fluidic communication with the low-pressure fuel outlet 502 to the tank via a second restriction 541 and a servo valve 52 arranged between the outlet 502 and the second restriction 541.

Figure 4A:
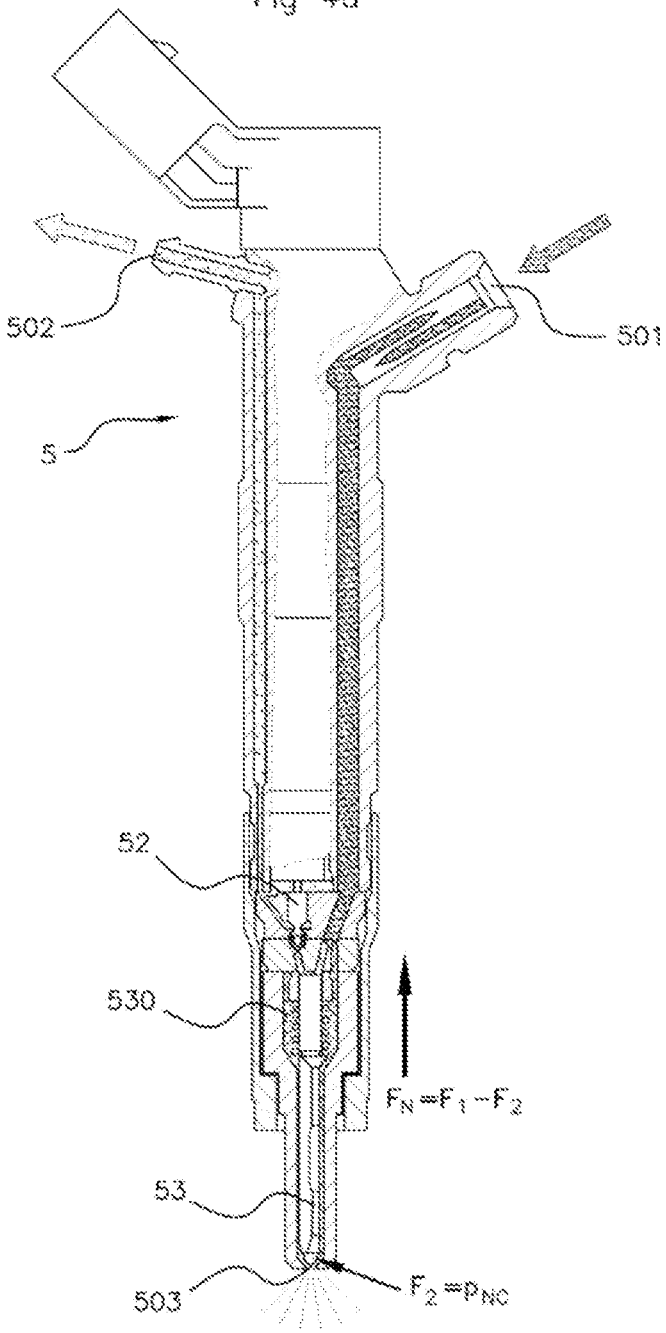
FIG. 4*a* shows a piezo-electric injector in the injection position.
Figure 4B:
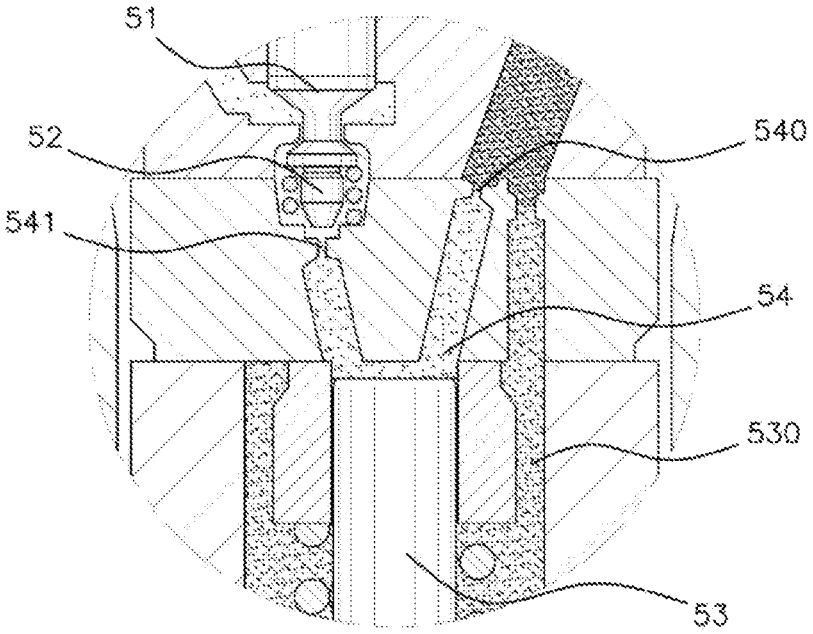
FIG. 4*b* shows an enlarged view of a servo valve and control chamber of the piezo-electric injector from FIG. 4*a*.

The injector also comprises a piezo-electric actuator 51 which, when it receives an electrical pulse from the electrical generator 8, is able to press on the servo valve 52. Pressing on the servo valve 52, as shown in FIGS. 4*a* and 4*b*, authorizes a circulation of fluid from the high-pressure fuel circuit of the injector towards the low-pressure outlet 502, which causes a fall in the pressure in the control chamber 54 and a movement of the needle 53 under the effect of the high pressure remaining in the first chamber 530, in order to open the orifice 503. In this way, the fuel may pass from the supply rail 4 to the combustion chamber via the orifice 503 and thus trigger an injection into said combustion chamber. This is the traditional function method of a piezo-electric injector.

The opening of the needle is not however immediate, and by controlling the opening of the servo valve via the current applied to the piezo-electric actuator, it is possible to generate a leakage current from the high-pressure inlet 501 to the low-pressure outlet 502 and the fuel tank without moving the needle, and hence without generating an injection.

In this case, the method described herein and with reference to FIG. 1 allows the fuel to pass from the supply rail 4 via the plurality of injectors 5, directing it towards the fuel tank 3, so as to discharge the pressure in the fuel rail 4. For example, when a driver releases the accelerator again, it is necessary to discharge the pressure $P_{rail}$ so that it can follow the reference pressure $P_{ref}$ determined by the engine computer. The method therefore proposes using a fuel leak created by the plurality of injectors 5 on opening of their respective servo valves 52, in order to cause the fuel to pass from the supply rail 4 to the fuel tank 3 and thus discharge the pressure $P_{rail}$.

Figure 5:
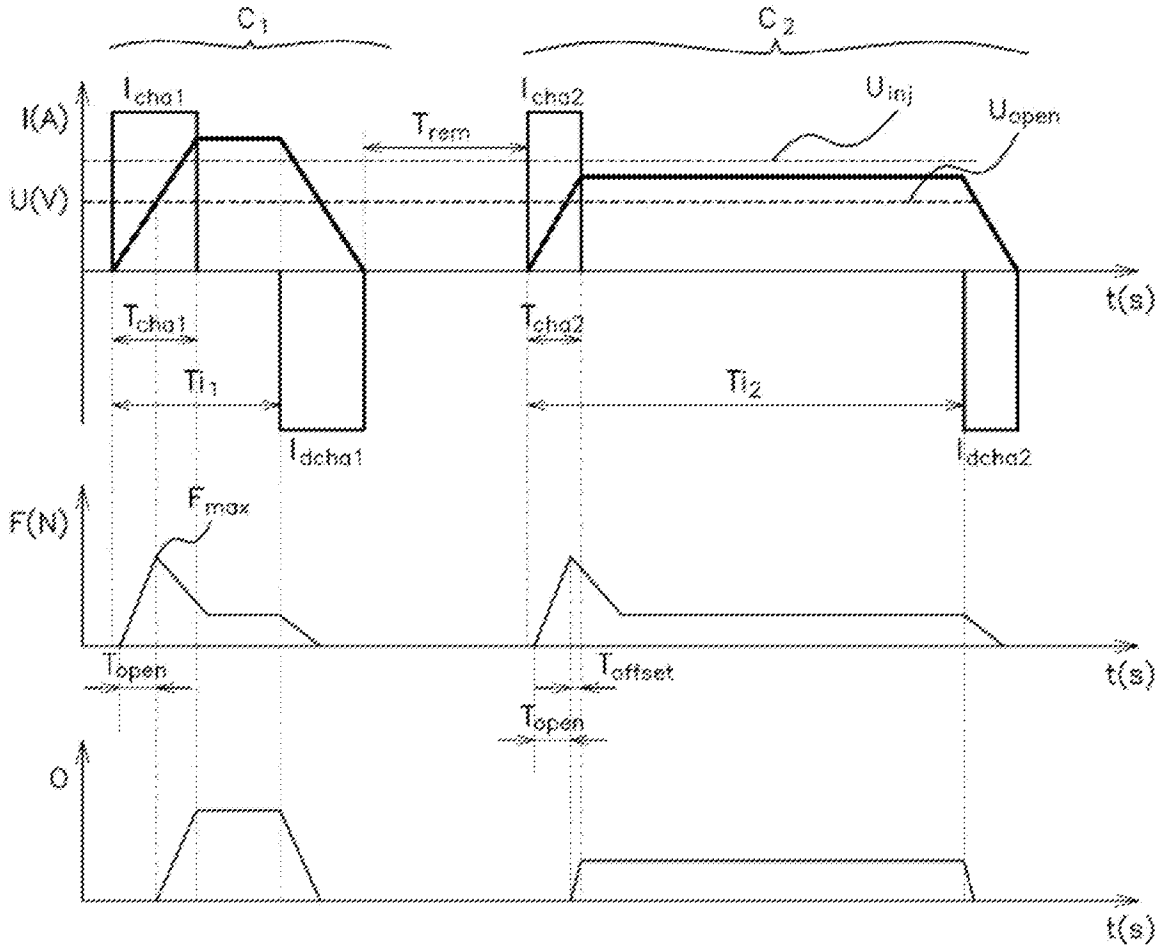
FIG. 5 shows, on the top graph, an example of an electrical pulse train allowing a voltage charge of a piezo-electric actuator of an injector and causing a pressure discharge of the fuel supply rail. The middle graph shows the development of the force exerted by the piezo-electric actuator on the servo valve of the injector. The bottom graph shows the opening of the servo valve caused by the electrical pulse train.

The method of discharging the pressure in a fuel rail 4 of an injection system 1 of an engine of a vehicle, described above with reference to FIG. 1, is implemented in the vehicle during a phase of release of the accelerator, i.e. when there is no request for a quantity of fuel to be injected. Reference will also be made to FIG. 5 during the description of the method. The graph at the top of the figure shows an electrical pulse train sent by the electrical generator 8 to a piezo-electric actuator 51 of an injector 5. The same graph also shows a voltage at the terminals of the piezo-electric actuator 51 in response to the electrical pulses. The graph in the middle of the figure shows the force exerted by the piezo-electric actuator 51 which receives the pulses on the servo valve of the injector 5. Finally, the graph at the bottom shows the opening 0 of the servo valve of the injector in response to the force applied by the piezo-electric actuator.

A first step 110 of the method comprises a comparison, on each engine cycle, between the reference pressure $P_{ref}$ determined by the engine computer and the pressure $P_{rail}$ measured by the pressure sensor 6. This is to identify whether the pressure $P_{rail}$ is greater than the pressure $P_{ref}$ so as to be able to implement the remaining steps of the method. In this way, if it is not necessary to discharge the pressure $P_{rail}$ in the supply rail 4, the method waits for the next engine cycle The method is therefore implemented on each engine cycle.

Advantageously, the remaining steps of the method are implemented when the difference between the pressure $P_{rail}$ in the rail and the reference pressure $P_{ref}$ is greater than a defined threshold. For example, if the difference by which the pressure $P_{ref}$ is exceeded reaches a defined percentage or an absolute value, the remaining steps are implemented.

A second step 120 of the method comprises the sending of a first electrical command $C_1$ by the electrical generator 8 to the piezo-electric actuator 51 of at least one injector 5 of the plurality.

With reference to FIG. 5, the first electrical command $C_1$ comprises an electric charge pulse $I_{cha1}$ of a defined duration $T_{cha1}$ and a electric discharge pulse $I_{dcha1}$ of the piezo-electric actuator 51. In an electric charge pulse $I_{cha1}$, the current applied is positive, causing an increase in voltage at the terminals of the piezo-electric actuator 51. In an electric discharge pulse $I_{dcha1}$, the current applied is negative, causing a reduction in voltage at the terminals of the piezo-electric actuator 51.

In fact, an increase in voltage of the piezo-electric actuator 51 mechanically corresponds to an elongation of the piezo-electric unit and hence to an application of force on the servo valve 52. Conversely, a reduction in voltage of the piezo-electric actuator 51 corresponds mechanically to a shrinkage of the piezo-electric actuator 51.

The charge time duration $T_{cha1}$ of the piezo-electric actuator 51 is determined so as to cause a complete charge of the piezo-electric actuator 51 of the at least one injector 5. A complete charge of the piezo-electric actuator 51 means that the piezo-electric actuator 51 is charged to allow both an opening of the servo valve 52 and an opening of the needle 53 of the injector 5. Advantageously, the piezo-electric actuator 51 of the at least one injector 5 reaches its voltage saturation level following the electric charge pulse $I_{cha1}$.

According to one embodiment, the electric discharge pulse $I_{dcha1}$ is symmetrical to the electric charge pulse $I_{cha1}$. This means that the electric discharge pulse $I_{dcha1}$ has an intensity substantially opposite to the intensity of the electric charge pulse $I_{cha1}$ and that the durations of the two pulses are substantially the same ($I_{dcha1} \approx -I_{cha1}$).

The first electrical command $C_1$ also comprises a defined duration $T_{i1}$ corresponding to the time elapsing between the start of the electric charge pulse $I_{cha1}$ and the start of the electric discharge pulse $I_{dcha1}$ of the piezo-electric actuator 51. The duration $T_{i1}$ is advantageously determined such that the needle 53 of the at least one injector 5 remains immobile.

In this case, the duration $T_{i1}$ is therefore advantageously determined such that, even if the charge time duration $T_{cha1}$ is sufficiently long for the voltage level at the terminals of the piezo-electric actuator 51 to be greater than a threshold voltage $U_{inj}$ allowing opening of the needle 53, the inertia of the needle 53 keeps the latter immobile. The duration $T_{i1}$ may be determined during a calibration phase by determining, via an injected quantity measuring device, a maximum duration above which the injection takes place.

An example of a first electrical current command $C_1$ is shown in FIG. 5. This figure also shows in dotted lines the voltage threshold $U_{inj}$ for which the piezo-electric actuator 51 is sufficiently charged to allow opening of the needle 53.

A third step 130 of the method comprises the determination, from a value of a force exerted by the piezo-electric actuator 51 on the servo valve 52, of a charge time duration $T_{open}$ allowing opening of the servo valve 52 of the at least one injector 5. More precisely, the charge time duration $T_{open}$ is determined from a development of the force exerted by the piezo-electric actuator 51 on the servo valve 52 during the first electrical command $C_1$ of the at least one injector 5.

In fact, the first electrical command $C_1$, which causes a complete charge of the piezo-electric actuator 51 without producing an injection, is used in this step to estimate the charge time duration $T_{open}$ causing the opening of the servo valve 52. The duration $T_{open}$ in reality corresponds to a first voltage level $U_{open}$ of the piezo-electric actuator 51 for which the servo valve 52 opens without triggering the opening of the needle 53, which itself corresponds to a second voltage level $U_{inj}$ of the piezo-electric actuator 51.

As shown in FIG. 5, the moment of starting of the opening of the servo valve 52 corresponds to a maximum force $F_{max}$. The force applied by the piezo-electric actuator to the servo valve is determined from a voltage U applied to the terminals of the piezo-electric actuator 51, from a capacitance value C of the piezo-electric actuator 51, and from a quantity value Q of electric charges transferred from the electrical generator 8 to the piezo-electric actuator 51. Thus the determination of the force exerted by the piezo-electric actuator 51 on the servo valve 52 is mathematically approximated by the following formula:

$$F \approx U \times C - Q \quad \text{[Math. 1]}$$

wherein F corresponds to the force exerted by the piezo-electric actuator 51 on the servo valve 52, U corresponds to a voltage applied to the terminals of the piezo-electric actuator 51, C corresponds to a capacitance value of the piezo-electric actuator 51, and Q corresponds to a quantity value of electric charges transferred from the electrical generator 8 to the piezo-electric actuator 51.

Consequently, step 130 comprises measurement, during application of the first electrical command $C_1$, of the voltage at the terminals of the piezo-electric actuator 51 and of the quantity of electrical charges transferred to the piezo-electric actuator 51 by the electrical generator 8, in order to deduce from these the force exerted by said actuator, and detection of the maximum force during application of the first electrical command $C_1$.

Once the duration $T_{open}$ allowing opening of the servo valve 52 for the at least one injector 5 has been determined, a fourth step 140 comprises the sending of a second electrical command $C_2$ by the electrical generator 8 to said piezo-electric actuator 51 of the at least one injector 5.

The second electrical command $C_2$ comprises an electric charge pulse **6*a*2 of a defined duration $T_{cha2}$ and an electric discharge pulse $I_{dcha2}$ of the piezo-electric actuator 51. The charge time duration $T_{cha2}$ of the piezo-electric actuator 51 is determined so as to obtain an opening of the servo valve 52 of the at least one injector 5 without triggering an injection. It is therefore determined from the duration $T_{open}$ of the opening of the servo valve 52**, since it must be greater than this opening duration.

In addition, the charge time duration $T_{cha2}$ is advantageously determined such that the voltage at the terminals of the piezo-electric actuator 51 is greater than a first voltage threshold triggering the opening of the servo valve 52 (not shown), and less than a second voltage threshold $U_{inj}$ triggering the opening of the needle 53.

Advantageously, the intensity associated with the electric charge pulse is $I_{cha2}$ of the second electrical command $C_2$ is substantially the same as that of the electric charge pulse $I_{cha1}$ of the first electrical command $C_1$. This means that the at least one injector 5 is under the same conditions as during first electrical command $C_1$, and therefore the moment of opening of its servo valve 52 is substantially the same. This therefore facilitates determination of the value $T_{cha2}$.

According to one embodiment, the second electrical command $C_2$ is performed by allowing at least one time lapse $T_{rem}$, not equal to zero, to pass after the end of the first electrical command $C_1$ so as to limit the impact of the electrical remanence of the piezo-electric actuator 51. The effects of electrical remanence would disrupt the similarity between the response of the piezo-electric actuator to the electrical pulse $I_{cha1}$ and the response of the piezo-electric actuator to the electrical pulse $I_{cha2}$, which could modify the moment of opening of the servo valve 52.

According to one embodiment, the charge time duration $T_{cha2}$ is equal to the sum of the duration $T_{open}$ causing the opening of the servo valve 52 and another duration $T_{offset}$ allowing opening of said servo valve 52 to a varying extent.

The duration $T_{offset}$ is thus used as a regulator as a function of the desired pressure fall. It lies strictly between a value of zero, for which $T_{cha2}$ is equal to $T_{open}$, and a second value allowing opening of the needle 53. It will be understood here that the closer this value comes to zero, the smaller the leakage of fuel from the at least one injector 5 to the tank 3, and hence the smaller the discharge of pressure in the fuel supply rail 4. Conversely, the greater the duration $T_{offset}$, the greater the fuel leakage. In fact, if the duration $T_{offset}$ is too great, the voltage at the terminals of the piezo-electric actuator 51 will exceed the injection threshold $U_{inj}$ and therefore an injection will be triggered if this voltage is applied for a sufficiently long time.

The second value, allowing opening of the needle, is predefined on test benches using the characteristic of the observed fall in fuel pressure in the supply rail as a function of the charge time of the piezo-electric actuator. This characteristic clearly shows a charge time value above which the pressure fall is substantially intensified because of the injection of fuel into the cylinder. Thus the second value associated with the duration $T_{offset}$ may be determined. Naturally, the second value may be deliberately set below the critical value causing injection, as a safety measure.

It will also be understood that when the piezo-electric actuator 51 is in the desired voltage range between the opening of the servo valve and the opening of the needle 53, no injection can take place. The servo valve 52 may therefore remain open to discharge the pressure in the fuel supply rail 4 for a maximum duration, depending on the capability of the electrical generator and the development of pressure in the fuel supply rail 4, which must not influence the level of opening of the servo valve, at the risk of opening the servo valve 52 too much and triggering an injection.

To this extent, the second electrical command $C_2$ also comprises a defined duration $T_{i2}$ corresponding to the time elapsing between the start of the electrical charge pulse $I_{cha2}$ and the start of the electrical discharge pulse $I_{dcha2}$ of the piezo-electric actuator 51. The duration $T_{i2}$ is advantageously determined such that the development of pressure in the supply rail 4 during the current combustion cycle of the engine does not influence the opening level of the servo valve 52 enough to trigger an injection.

The defined duration $T_{i2}$ is thus advantageously determined to be greater than a duration allowing breakage of the inertia of the needle 53 of the at least one injector 5, since the voltage level of the piezo-electric actuator 51 is not sufficient to cause the opening of the needle 53.

The duration $T_{i2}$ less the duration $T_{open}$ allowing the opening of the servo valve 52 of the at least one injector 5 ($T_{i2}-T_{open}$) in fact corresponds to the fuel leakage time of the at least one injector 5. Insofar as the method is implemented for each combustion cycle of the engine in the accelerator release phase, the duration $T_{i2}$ is determined as a function of the engine speed, the pressure in the fuel supply rail 4, and the amount of the desired pressure fall.

An example of a second electrical current command $C_2$ is shown in FIG. 5. The voltage at the terminals of the piezo-electric actuator 51 is thus less than the threshold voltage $U_{inj}$ but sufficient to open the servo valve 52 and hence cause a leakage of fuel from the supply rail 4 to the tank 3.

The method described above is therefore optimized with respect to the current operating conditions of the engine, because it allows adaptation of the fuel leak to the tank on each engine combustion cycle without risk of injection. The optimization extends beyond the operating conditions of the engine since it extends to the operating conditions of each injector, insofar as determination of the moment of opening of the servo valve is specific to each injector. The method therefore proposes an alternative to the installation of a pressure decay valve in the supply rail, while being less complex and more economic, without the addition of any further component.

Also, the sequence of only two electrical commands to the piezo-electric actuator of the injector on each engine combustion cycle during an accelerator release phase does not overly stress the piezo-electric actuator and therefore does not cause premature wear of the injector.

The invention claimed is:

1. A method for discharging the pressure in a fuel supply rail of an injection system of an engine of a vehicle, said fuel supply rail being connected to a fuel tank by a plurality of piezo-electric injectors, each of the piezo-electric injectors including a needle and a piezo-electric actuator configured to press on a servo valve of the injector, the injection system including a fuel pressure sensor for the supply rail and an electrical generator configured to transmit electric current pulses to the piezo-electric actuator of each of the piezo-electric injectors, said method being implemented during a phase of release of an accelerator for which no request for fuel injection has been made, the method comprising:

comparing, by a computer, on each engine cycle, a defined reference fuel pressure for the fuel supply rail with a measured fuel pressure in the fuel supply rail measured by the pressure sensor, and when the measured fuel pressure is greater than the defined reference fuel pressure:

sending, by the electrical generator, a first electrical command to the piezo-electric actuator of at least one piezo-electric injector of the plurality of piezo-electric injectors, the first electrical command comprising an electric charge pulse of a defined first duration determined to cause a complete charge of the piezo-electric actuator of the at least one injector, an electric discharge pulse of the piezo-electric actuator, a defined second duration corresponding to the time elapsing between the start of the electric charge pulse and the start of the electric discharge pulse of the piezo-electric actuator of the at least one injector, the defined second duration corresponding to the elapsing time being determined such that the needle of the at least one injector remains immobile, determining, from a value of a force exerted by the piezo-electric actuator on the servo valve during the first electrical current command, a charge time duration allowing an opening of the servo valve of the at least one injector, and sending, by the electrical generator, a second electrical command to the piezo-electric actuator of said at least one injector, the second electrical command comprising an electric charge pulse of a defined third duration, an electric discharge pulse of the piezo- electric actuator, and a defined fourth duration corresponding to the time elapsing between the start of the electric charge pulse and the start of the electric discharge pulse of the piezo-electric actuator, the defined fourth duration being determined from the charge time duration of the at least one injector to allow the opening of the servo valve of said at least one injector while keeping the needle immobile, so that the voltage at the terminals of the piezo-electric actuator is higher than a first voltage threshold triggering the opening of the servo valve and lower than a second voltage threshold triggering the opening of the needle, the defined second duration being determined as a function of an engine speed, the pressure in the fuel supply rail, and a desired pressure discharge.

2. The method as claimed in claim 1, wherein the defined fourth duration being greater than a breakage duration allowing breakage of the inertia of the needle of the at least one injector.

3. The method as claimed in claim 2, wherein the charge time duration allowing the opening of the servo valve is determined by measuring a voltage applied to the piezo-electric actuator and a quantity value of electric charges transferred from the electrical generator to the piezo-electric actuator of the at least one injector.

4. The method as claimed in claim 2, wherein the opening of the servo valve is detected when the force exerted by the piezo-electric actuator on the servo valve is at a maximum, the force exerted by the piezo-electric actuator on the servo valve being determined from:

the voltage applied to the piezo-electric actuator, a capacitance value of the piezo-electric actuator, and a quantity value of electric charges.

5. The method as claimed in claim 2, wherein the defined third duration of the second electrical command is equal to the charge time duration of the servo valve, to which a fifth defined duration is added.

6. The method as claimed in claim 2, wherein at least one time lapse not equal to zero separates the two electrical commands.

7. A non-transitory computer-readable medium on which is stored a computer program, comprising code instructions to implement the method as claimed in claim 2 when said program is executed on a computer that is configured to control the injection system of the engine of the vehicle, said system including the fuel supply rail connected to the fuel tank by the plurality of piezo-electric injectors, each piezo-electric injector including the needle and the piezo-electric actuator configured to press on the servo valve of the injector, the injection system including the fuel pressure sensor for the supply rail and the electrical generator configured to transmit the electric current pulses to the piezo-electric actuator of each injector.

8. The method as claimed in claim 1, wherein the charge time duration allowing the opening of the servo valve is determined by measuring a voltage applied to the piezo-electric actuator and a quantity value of electric charges transferred from the electrical generator to the piezo-electric actuator of the at least one injector.

9. The method as claimed in claim 8, wherein the opening of the servo valve is detected when the force exerted by the piezo-electric actuator on the servo valve is at a maximum, the force exerted by the piezo-electric actuator on the servo valve being determined from:

the voltage applied to the piezo-electric actuator, a capacitance value of the piezo-electric actuator, and the quantity value of electric charges.

10. The method as claimed in claim 8, wherein the defined third duration of the second electrical command is equal to the charge time duration of the servo valve, to which a fifth defined duration is added.

11. The method as claimed in claim 8, wherein at least one time lapse not equal to zero separates the two electrical commands.

12. A non-transitory computer-readable medium on which is stored a computer program, comprising code instructions to implement the method as claimed in claim 8 when said program is executed on a computer that is configured to control the injection system of the engine of the vehicle, said system including the fuel supply rail connected to the fuel tank by the plurality of piezo-electric injectors, each piezo-electric injector including the needle and the piezo-electric actuator configured to press on the servo valve of the injector, the injection system including the fuel pressure sensor for the supply rail and the electrical generator configured to transmit the electric current pulses to the piezo-electric actuator of each injector.

13. The method as claimed in claim 1, wherein the opening of the servo valve is detected when the force exerted by the piezo-electric actuator on the servo valve is at a maximum, the force exerted by the piezo-electric actuator on the servo valve being determined from:

the voltage applied to the piezo-electric actuator, a capacitance value of the piezo-electric actuator, and a quantity value of electric charges.

14. The method as claimed in claim 13, wherein the defined third duration of the second electrical command is equal to the charge time duration of the servo valve, to which a fifth defined duration is added.

15. The method as claimed in claim 13, wherein at least one time lapse not equal to zero separates the two electrical commands.

16. The method as claimed in claim 1, wherein the defined third duration of the second electrical command is equal to the charge time duration of the servo valve, to which a fifth defined duration is added.

17. The method as claimed in claim 16, wherein at least one time lapse not equal to zero separates the two electrical commands.

18. The method as claimed in claim 1, wherein at least one time lapse not equal to zero separates the two electrical commands.

19. A computer that is configured to implement the method as claimed in claim 1 and control the injection system of the engine of the vehicle, said injection system including the fuel supply rail connected to the fuel tank by the plurality of piezo-electric injectors, each piezo-electric injector including the needle and the piezo-electric actuator configured to press on the servo valve of the injector, the injection system including the fuel pressure sensor for the supply rail and the electrical generator configured to transmit the electric current pulses to the piezo-electric actuator of each injector.

20. A non-transitory computer-readable medium on which is stored a computer program, comprising code instructions to implement the method as claimed in claim 1 when said program is executed on a computer that is configured to control the injection system of the engine of the vehicle, said system including the fuel supply rail connected to the fuel tank by the plurality of piezo-electric injectors, each piezo-electric injector including the needle and the piezo-electric actuator configured to press on the servo valve of the injector, the injection system including the fuel pressure sensor for the supply rail and the electrical generator configured to transmit the electric current pulses to the piezo-electric actuator of each injector.

* * * * *